United States Patent [19]

Mailer

[11] 4,341,480

[45] Jul. 27, 1982

[54] FEED MECHANISM FOR CONTINUOUS AND CUT FORM PAPER

[75] Inventor: Werner H. Mailer, Waynesboro, Va.

[73] Assignee: General Electric Company, Waynesboro, Va.

[21] Appl. No.: 106,507

[22] Filed: Dec. 26, 1979

[51] Int. Cl.[3] ..... B41J 13/16

[52] U.S. Cl. ..... 400/625; 400/629; 400/645; 400/647.1; 400/636

[58] Field of Search ..... 400/625, 602, 642, 645, 400/644, 629, 636, 647, 647.1, 646, 605, 146; 101/111

[56] References Cited

U.S. PATENT DOCUMENTS

| | | | |
|---|---|---|---|
| 2,244,095 | 6/1941 | Botham et al. | 400/645.5 |
| 3,027,992 | 4/1962 | Runde et al. | 400/602 |
| 3,391,775 | 7/1968 | Fröbel | 400/602 |
| 3,430,748 | 3/1969 | Parri | 400/625 |
| 3,753,483 | 8/1973 | Lundquist et al. | 400/146 |
| 3,966,037 | 6/1976 | Zambolin | 400/636 |
| 4,089,402 | 5/1978 | Hyland et al. | 400/629 |
| 4,212,456 | 7/1980 | Ruenzi | 400/625 |

FOREIGN PATENT DOCUMENTS

| | | | |
|---|---|---|---|
| 2716396 | 10/1978 | Fed. Rep. of Germany | 400/605 |
| 2854695 | 7/1979 | Fed. Rep. of Germany | 400/625 |
| 2026391 | 2/1980 | United Kingdom | 400/625 |

OTHER PUBLICATIONS

Cassell et al., "Cut Forms Feed Gate", IBM Technical Disclosure Bulletin, vol. 23, No. 3, p. 903, 8/80.

Drejza, "Record Sheet Deflector" IBM Technical Disclosure Bulletin, vol. 19, No. 6, p. 2040, 11/76.

*Primary Examiner*—William Pieprz

*Attorney, Agent, or Firm*—Michael Masnik

[57] ABSTRACT

A cut form paper transport apparatus in a belt printer includes driven exit friction rollers disposed for rolling engagement with a pressure roller pivotally supported on a pair of support arms which carry a deflector or guide plate spaced above the platen and disposed for engagement with the leading edge of a sheet of paper as it leaves the printing region for deflection of the leading edge into an exit path tangent to the platen and such that the leading edge of the sheet moves between the exit friction rollers and the pressure roller for engagement thereby when the sheet is in the exit path. Mounted on the deflector plate is a pair of adjustment rollers disposed for rolling engagement with the outer surface of the platen for adjusting the position of the deflector plate with respect to the platen.

5 Claims, 3 Drawing Figures

62
61
75
46
60
54
76
55
63
45
70
51
74
69
73
64
72
78
65
46
21
66
20
17
18
10
48
47
33
45
22
41
19
32
25
39
34
35
16
31
36
38
40
37
81
30
80

FEED MECHANISM FOR CONTINUOUS AND CUT FORM PAPER

BACKGROUND OF THE INVENTION

The present invention relates to friction feed mechanisms for continuous and cut form paper. In particular, the invention relates to improved means for feeding cut forms to and from the information recording or reproducing region of an information handling device.

In an impact printing machine there is generally provided a cylindrical platen around which the paper is fed, a printing mechanism disposed in a printing region adjacent to the platen and an inked ribbon disposed between the printing mechanism and the platen. In operation, the printing mechanism impacts the inked ribbon and drives it against the paper on the platen to perform the printing operation. It is essential that the paper be held against the platen in the printing region so that the paper will have a firm base therebeneath, against which the printing elements can be struck. It is also important that no bulges or slack regions be formed in the paper to insure that as the paper is advanced by the feed mechanism, the portion of the paper in the printing region will move the same distance as the portion in the feed mechanism to insure accurate spacing between lines of print.

In standard typewriters these requirements are met by providing guide means which positively guide the paper along substantially its entire path around the platen and through the printing region. But in line printers of the continuous belt type, such paper guides cannot be used because in the printing region an opening or window must be provided along the entire length of the platen, since plural points anywhere along the platen may be imprinted simultaneously.

Typically, line printers are designed for use with continuous form paper. In such machines the leading edge of the continuous form is hand-fed around the platen and through the printing region and engaged with a drive mechanism downstream from the printing region, which drive mechanism serves to pull the paper through the printing region, this pulling action serving to hold the paper against the platen. The drive mechanism may be in the form of pinwheels, pressure rollers and other tractor devices which engage apertures in the edges of the paper form.

While the foregoing arrangement works fine for continuous forms, it cannot be used with cut forms in discrete sheets, since there is no means for automatically feeding such sheets through the machine. More specifically, there is no mechanism for effectively driving the sheet through the printing region and to the point at which the leading edge engages the tractor mechanism. In a conventional typewriter, this feeding is effected through a friction feed mechanism comprising friction rollers cooperating with the driven platen frictionally to drive the paper therebetween. Such friction feed mechanism is typically below the platen and serves to push the paper upwardly around the platen and to the printing region. Additional pinch rollers may then be used above the printing region to assist in guiding the paper and holding it against the platen.

Attempts to use this standard friction drive mechanism with belt-type line printers such as chains or bands for permitting the automatic feeding of discrete sheets therethrough have not been successful for several reasons. First of all, the use of a friction feed which pushes the paper through the printing region will not suffice, in and of itself, to permit automatic feeding of discrete sheets. This is because once the trailing edge of the sheet passes the friction feed mechanism, the sheet will no longer be driven. Thus, the last couple of inches of the sheet cannot be moved through the printing region. Therefore, it is necessary additionally to use some sort of auxiliary feed mechanism which engages the leading edge of a sheet downstream of the printing region for pulling the tail end of the form through the printing region. In standard typewriters this is achieved by the use of an additional set of friction rolers directly on the driven platen downstream from the printing region. But, as will be explained below, such an arrangement cannot be used in the belt-type line printer.

Secondly, the discrete sheet forms cannot be positively guided all the way through the printing region for the reasons set forth above. This means that it will be necessary that the sheet traverse an unguided or free path portion through the printing region. Where the positive guiding ceases, the leading edge of the paper will tend to diverge from the platen generally tangent thereto. This free path portion is arranged so that the sheet does not contact the print ribbon, otherwise it will foul the ribbon and cause jamming thereof, and/or create a paper jam and smudges on the paper. Since the paper sheet leaves the platen in the printing region, it must be picked up after it clears the ribbon and be guided back to the platen.

It has been found that if upper pinch rollers directly on the platen are used for this purpose and to provide the exit drive for the sheet, the leading edge of the paper must be rapidly deflected back to the platen surface to engage the pinch roller, thereby creating a bulge or hump in the paper path between the printing region and the upper pinch rollers. Such a bulge is unacceptable because once the trailing end of a sheet passes the entry friction feed so that it is no longer pushed, the pulling force exerted by the exit friction drive would first take up the slack in the paper hump or bulge before continuing to move the paper through the printing region. During this slack take-up period, therefore, line spacing in the printing region would be nonexistent or at best very uneven.

SUMMARY OF THE INVENTION

It is a general object of the present invention to provide an improved web, such as paper, transport means for transporting a web available in various forms through an information handling device, such as a printer.

It is another object of this invention to provide a paper transport mechanism which will effect movement of cut forms from the printing region of the platen without the formation of slack-producing bulges in the sheet downstream of the printing region.

Still another object of this invention is to provide an improved paper transport mechanism of the type set forth which is adapted for use in combination with a pinch roller type of entry feed mechanism which feeds the paper sheet to the printing region.

Yet another object of this invention is the provision of a paper transport mechanism of the type set forth, which is readily removably attached to a line printer normally adapted for feeding of continuous forms, without the removal of or interference with the normal continuous form transport mechanism.

It is another object of this invention to provide an improved paper transport apparatus for use in a line printer having a frictional-type entry feed mechanism for feeding a sheet of paper to the printing region, the apparatus being disposed for driving engagement with the leading edge of a sheet leaving the printing region before the trailing edge passes the entry drive mechanism.

It is another object of this invention to provide an improved printing machine for handling continuous form paper and paper available as discrete sheets.

In connection with the foregoing objects, it is another object of this invention to provide a paper transport mechanism of the type set forth, which permits the use of a friction drive apparatus along the exit path from the printing region while avoiding the formation of slack-producing bulges in the paper sheet.

These and other objects are attained by providing paper guide apparatus for use with discrete sheets of paper in a continuous belt-type printing machine including a rotatable cylindrical platen, an inked ribbon disposed adjacent to the platen at a printing region, entry drive means for moving the sheets of paper into a printing path extending tangent to the platen through the printing region and past the inked ribbon spaced therefrom, and exit drive means spaced from the platen for moving the sheets of paper from the printing region; the paper guide apparatus comprising deflecting means spaced from the platen downstream of the printing region and disposed for engaging the leading edge of the associated sheet past the printing region, the deflecting means being shaped and dimensioned for deflecting the associated sheet into an exit path extending along the platen and thence in a straight line to the exit drive means tangent to the platen and such that the leading edge of the sheet engages the exit drive means when the sheet is in the exit path, whereby the leading edge of the associated sheet is held out of contact with the inked ribbon and is moved around the platen without the formation of slack-producing bulges in the sheet downstream of the printing region.

Further features of the invention pertain to the particular arrangement of the parts of the paper transport apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
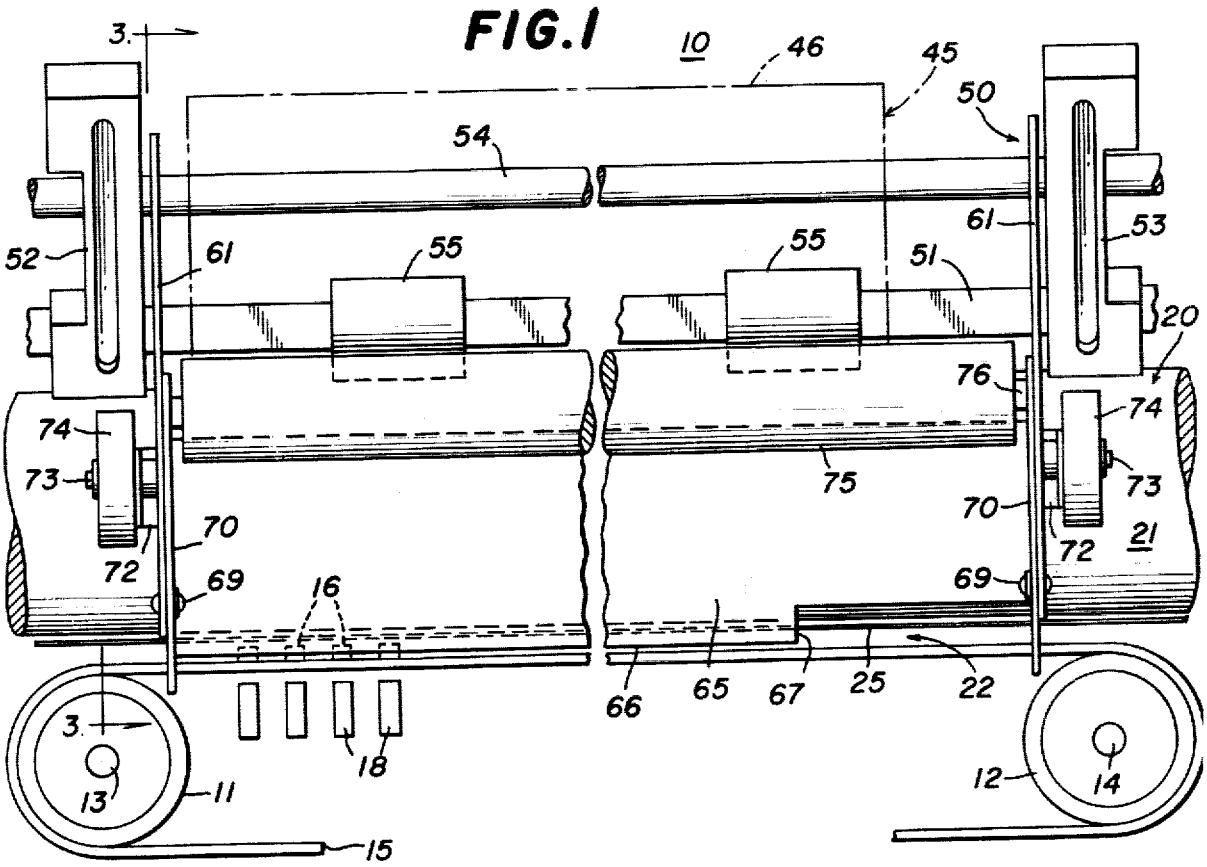
FIG. 1 is a fragmentary top plan view of the paper transport apparatus constructed in accordance with and embodying the features of the present invention, and illustrated mounted in place on a belt-type line printer.
Figure 2:
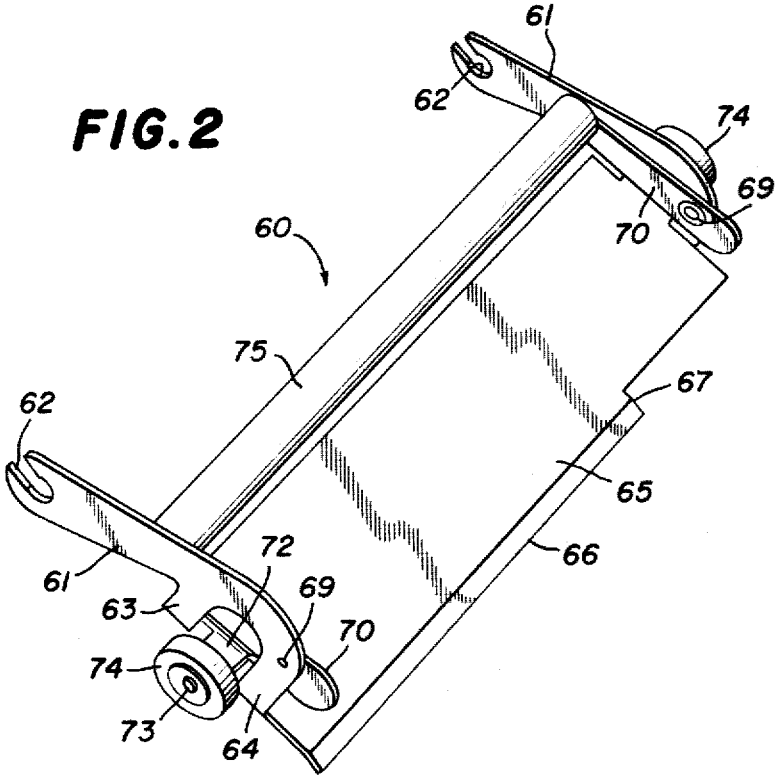
FIG. 2 is a reduced perspective view of the paper transport apparatus of FIG. 1.
Figure 3:
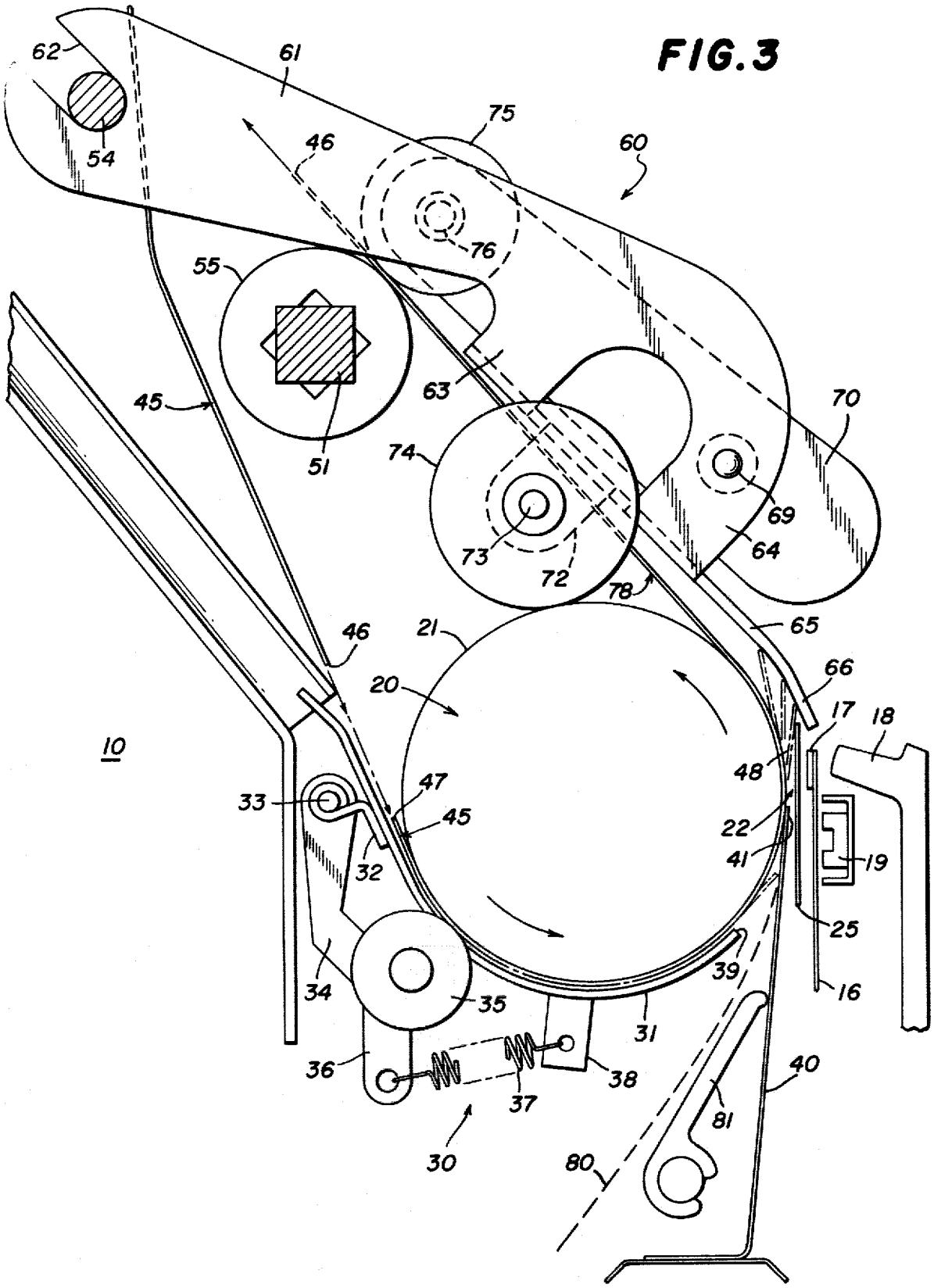
FIG. 3 is an enlarged fragmentary view in vertical section taken along the line 3—3 in FIG. 1.

Referring to FIGS. 1 through 3 of the drawings, there is illustrated a portion of a belt-type line printing machine, generally designated by the numeral 10. Such a printing machine may be of the type sold by General Electric Company under the trademark "TermiNet". The printing machine 10 includes two laterally spaced-apart pulleys 11 and 12 respectively rotatably mounted on shafts 13 and 14 and supporting therebetween an endless belt 15 which carries thereon a plurality of upstanding flexible printing fingers 16, each carrying at the upper end thereof a print or type character 17 facing outwardly of the belt 15. Mounted within the endless belt 15 adjacent to the front flight thereof (and aligned longitudinally thereof) is a plurality of print hammers 18. Disposed between the print hammers 18 and the printing fingers 16 and above the upper edge of the endless belt 15 is an elongated rebound bar 19. There is also provided an elongated cylindrical platen 20 coupled to associated drive means (not shown) for rotation thereof in a counterclockwise direction, as indicated by the arrows in FIG. 3. The platen 20 is arranged with the axis thereof disposed horizontally and has an outer surface 21 disposed closely adjacent to the row of type characters 17 at a printing region 22. Extending between the platen 20 and the row of type characters 17 along the entire length thereof in the printing region 22 is a length of print ribbon 25 which is disposed in a substantially vertical plane, and which is fed from and retrieved by an associated cartridge (not shown) for movement from right to left, as viewed in FIG. 1. Preferably, the path of the print ribbon 25 through the printing region 22 is slightly inclined downwardly from right to left, as viewed in FIG. 1, for more efficient use of the space on the print ribbon, in a well-known manner.

In operation, the print hammers 18 are selectively pivoted in a counterclockwise direction, as viewed in FIG. 3, by associated actuators (not shown) against the urging of bias means (not shown) for impacting selected ones of the printing fingers 16 and driving the associated print characters 17 against the print ribbon 25 and moving the ribbon against an associated sheet of paper disposed along the outer surface 21 of the platen 20 in the printing region 22. After impact, the print hammer 18 will be returned to its original position by its bias means, and the resilient printing finger 16 will spring back toward its original position and engage the rebound bar 19, which serves to cushion the return of the printing finger 16 and damp out oscillations thereof. The operation of this type of printing mechanism is described in greater detail in U.S. Pat. No. 3,803,558.

Referring in particular to FIG. 3 of the drawings, the printing machine 10 includes an entry paper transport assembly, generally designated by the numeral 30, for moving paper from an associated source around the platen 20 and toward the printing region 22. The entry paper transport assembly 30 includes an arcuate guide plate 31 which wraps around the underside of the platen 20 coaxially therewith and spaced a predetermined slight distance from the outer surface 21 thereof. Preferably, the guide plate 31 extends laterally substantially the entire length of the platen 20, the guide plate 31 being fixedly secured to the framework of the machine 10 in a suitable manner.

Fixedly secured to the guide plate 31 and projecting rearwardly therefrom is a plurality of mounting brackets 32, each supporting a pivot pin 33, on which are respectively pivotally mounted a plurality of depending arms 34. Each of the arms 34 carries thereon intermediate the ends thereof a rotatably mounted pinch roller 35 which projects upwardly through a complementary opening in the guide plate 31 for rolling engagement with the outer surfaces 21 of the platen 20. Each of the arms 34 is provided with a depending finger 36 which is secured to one end of an associated tension spring 37, the other end of which is anchored to a tab 38 fixedly secured to and depending from the guide plate 31, thereby resiliently to urge the pinch roller 35 into engagement with the platen 20.

The guide plate 31 terminates at a forward edge 39 which is disposed adjacent to the printing region 22, but spaced therefrom. There is also provided a flat planar deflecting plate 40 which extends laterally substantially the entire length of the platen 20 and projects upwardly in front thereof, the upper edge 41 of the deflecting plate 40 being disposed in the printing region 22 immediately below the level of the print characters 17 and resiliently urged into tangent engagement with the outer surface 21 of the platen 20.

In operation, cut forms in the form of discrete sheets of paper, generally designated by the numeral 45, are fed from an associated sheet feeding mechanism (not shown) into the printing machine 10 and downwardly along the rear side of the platen 20. More specifically, the leading edge 46 of a sheet is fed between the outer surface 21 of the platen 20 and the guide plate 31 and thence to the pinch rollers 35, which cooperate with the driven platen 20 to pick up the leading end of the sheet 45 and drive it along the guide plate 31 toward the printing region 22. As the leading edge 46 of the sheet 45 passes the forward edge 39 of the guide plate 31, it will tend to continue along a path tangent to the outer surface 21 of the platen 20 at a point opposite the forward edge 39 of the guide plate 31. After traveling a short distance away from the platen 20 along this tangent path, the leading edge 46 of the paper sheet 45 will engage the deflecting plate 40 and be deflected thereby back toward the platen 20 and will be driven between the outer surface 21 of the platen 20 and the upper edge 41 of the deflecting plate 40 and will emerge therefrom in the printing region 22 along a printing path tangent to the platen 20 at the upper edge 41 of the deflecting plate 40, this printing path being designated by the numeral 48.

The orientation of the deflecting plate 40 and the position of the upper edge 41 thereof are so arranged that the printing path 48 clears the print ribbon 25. This insures that the leading edge 46 of the sheet will not engage the print ribbon 25, thereby preventing fouling of the ribbon or marring of jamming of the paper sheet 45. It will, of course, also be appreciated that the upper edge 41 of the deflecting plate 40 is spaced below the level of the type characters 17 so as to afford a window through which the type characters 17 can impact the print ribbon 25 and the associated sheet 45 without interference along the entire length of the platen 20.

The foregoing structure is found in existing belt-type impact line printers, but such prior printers have been designed solely for use with continuous form paper, such as computer paper and the like. Such continuous forms, shown as 80, available from a source such as a box for fanfold paper located below or behind the printing machine, are manually fed through the printing region 22 and the leading edge of the form is then engaged with a tractor assembly, generally designated by the numeral 50, disposed above and behind the platen 20 downstream of the printing region 22. Spring loaded arm 81 when deflected clockwise moves deflector 40 clockwise away from the platen to facilitate paper loading. In one embodiment deflector 40 was made of spring material and anchored for deflection about one end connected to the machine body. More particularly, the tractor assembly 50 may include a horizontally-extending drive shaft 51 generally rectangular in transverse cross section and coupled adjacent to the opposite ends thereof respectively with a left-hand tractor 52 and a right-hand tractor 53. Also interconnecting the upper ends of the tractors 52 and 53 is a laterally-extending tie rod 54, preferably circular in transverse cross section.

In operation, the tractors 52 and 53 are movable laterally along the tie rod 54 and drive shaft 51 into positions for respectively engaging the left and right-hand edges of the continuous form and driving the form upwardly away from the printing region 22. It will, therefore be appreciated that as soon as this tractor assembly 50 is engaged with the continuous form, it will pull it against the outer surface 21 of the platen 20 and this continuous pulling movement will prevent the formation of any bulges in the paper, since once the form is manually threaded through the machine, there are no further leading or trailing edges to be concerned with.

But this mechanism has proven to be unsuitable for use with automatically fed cut forms, since it provides no means for picking up the leading edge of each discrete sheet as it exits the printing region. More particularly, since the sheets are discrete, and since they cannot be continuously guided around the platen 20 because of the necessity of providing the printing window along the entire length of the platen 20, as described above, of necessity the leading edge 46 of each sheet 45 must leave the outer surface 21 of the platen 20 as it passes through the printing region 22. After leaving the printing surface, it must, therefore, be picked up and brought back to the surface 21.

In standard typewriters, where the paper is continuously guided through the printing region, this pickup is effected by an additional pinch roller on top of the platen. But this means is ineffective in a belt-type printer, where the leading edge 46 of the sheet 45 must leave the platen along an unguided portion of the print path, since when the leading edge of the sheet is deflected sharply back toward the pinch roller, it creates a bulge in the paper which is spaced from the surface 21 of the platen 20 between the printing region 22 and the upper pinch roller. This bulge creates no problem as long as the entry pinch rollers 35 are in engagement with the paper, since the leading and trailing ends of the sheet will both be driven at the same rate by the driven platen 20. But as soon as the trailing edge 47 of the sheet 45 passes the pinch rollers 35, the sole driving force will be imparted by the upper pinch rollers, which will then serve to take up the slack in the bulge. During this brief slack take-up period, the portion of the sheet in the printing region will remain substantially stationary, thereby destroying the line spacing.

In order to accommodate discrete sheets of paper instead of continuous form paper in the arrangement of FIG. 2, there is provided an exit transport assembly 60. The tractors 52 and 53 are moved laterally along the tie rod 54 beyond where they normally engage the right and left hand edges of the continuous form paper. The assembly 60 is inserted for converting the continuous form printing machine into a discrete sheet form printing machine. In the arrangement of FIGS. 1 and 2 there is mounted on the drive shaft 51 of the tractor assembly 50 for rotation therewith, two laterally spaced-apart friction rollers 55, preferably positioned inwardly of the innermost positions that the tractors 52 and 53 are likely to occupy in use with standard continuous forms. The friction rollers 55 cooperate to form part of an exit transport assembly, generally designated by the numeral 60, which includes a pair of laterally spaced-apart support arms 61 which are constructed substantially as mirror images of each other, whereby only one will be described in detail. Each arm 61 is provided at one end thereof with a slot 62 dimensioned to receive therein the tie rod 54 of the tractor assembly 50. The support arm 61 is provided adjacent to the other end thereof with two spaced-apart depending fingers 63 and 64, integral with the adjacent side edge of an elongated flat planar deflector or guide plate 65 which extends between the support arms 61 and is carried thereby. The guide plate 65 is provided at the forward edge thereof with a downwardly inclined lip 66 and is provided adjacent to the right-hand end thereof, as viewed in FIG. 1, with a rectangular cutout portion 67.

The forwardmost finger 64 of each of the support arms 61 carries thereon a pivot pin 69, there being respectively pivotally mounted on the pins 69 two elongated pivot arms 70, each of which is disposed above the guide plate 65 and projects upwardly rearwardly therealong. Respectively mounted at the opposite ends of the guide plate 65 between the fingers 63 and 64 are two depending tabs 72 which extend downwardly below the guide plate 65 away from the fingers 63 and 64. Each tab 72 carries thereon a pivot pin 73 on which is rotatably mounted an adjustment roller 74. An elongated pressure roller 75 is rotatably mounted on a shaft 76 which is carried by and extends between the rear ends of the pivot arms 70 for pivotal movement therewith. The pivot arms 70 thus cooperate to form a pivot carriage for the pressure roller 75.

In operation, the slots 62 of the support arms 61 are slipped over the tie rod 54 of the tractor assembly 50, and the forward end of the exit transport assembly 60 is lowered until the adjustment rollers 74 are brought into rolling engagement with the outer surface 21 of the platen 20. The diameter of the adjustment rollers 74 is carefully selected, so that when they are in engagement with the outer surface 21 of the platen 20, the pressure roller 75 will be in rolling engagement with the friction rollers 55, and the guide plate 65 will be spaced a predetermined distance above the platen 20, with the lip 66 thereof extending down over the upper edge of the print ribbon 25, but out of contact therewith. The cutout portion 67 on the guide plate 65 will accommodate the elevated right end of the inclined print ribbon 25.

In operation, the drive shaft 51 of the tractor assembly 50 is coupled to the platen 20 and is, therefore, driven simultaneously therewith in a well-known manner. Thus, the friction rollers 55 will cooperate with the pressure roller 75 to provide a friction drive therebetween. The dimensions and positioning of the guide plate 65 are such that the lip 66 thereof intersects the printing path 48 of the paper sheet 45 for engagement with the leading edge 46 of the sheet to deflect it rearwardly and upwardly along the guide plate 65, as indicated by the broken-line positions of the leading end of the sheet illustrated in FIG. 3. As the sheet 45 continues to be driven by the pinch rollers 35, the leading edge 46, because of the inherent stiffness of form paper, will slide along the underside of the guide plate 65 which will guide it without bulging into a straight-line exit path 78 which is tangent to the outer surface 21 of the platen 20 at a point upstream of the printing region 22.

The exit transport assembly 60 is so dimensioned and positioned that the leading edge 46 of the sheet 45 will enter between the friction rollers 55 and the pressure roller 75 when the sheet 45 lies in the tangent exit path 78. Thus, it will be appreciated that the leading edge 46 of the sheet 45 will be picked up by the friction rollers 55 and pressure roller 75 and frictionally driven thereby at a point spaced well away from the platen 20, and at a time when the sheet 45 is disposed in a path tangent to the platen 20, so that the sheet 45 lies against the outer surface of the platen 20 in the printing region 22 and there are no bulges therein. Thus, when the leading edge 46 of the sheet 45 is picked up and driven by the exit transport assembly 60, there is no slack to be taken up and there will be no loss of line spacing when the trailing edge 47 of the sheet 45 passes the pinch rollers 35. It will also be appreciated that the positioning of the friction rollers 55 is such that the friction drive provided thereby will be imparted to the sheet 45 before the trailing edge 47 of the sheet 45 passes the pinch rollers 35.

It is a significant feature of the present invention that the exit transport assembly 60 is readily removable from the printing machine 10 and can be simply and easily attached thereto without the necessity of removing any of the standard tractor assembly 50 used with continuous forms. Thus, when it is desired to operate the printing machine 10 with cut forms, the tractors 52 and 53 are simply moved outwardly toward the adjacent sides of the machine, and the exit transport assembly 60 is mounted in place by simply inserting the slots 62 over the tie rod 54. Thus, the printing machine 10 can easily be used with either continuous forms or cut forms by the use of a simply mounted attachment mechanism.

From the foregoing, it can be seen that there has been provided an improved paper transport apparatus for transporting cut forms through a belt-type impact printer without the formation of slack-producing bulges in the paper and resultant impairment of line spacing.

There has also been provided an improved paper transport mechanism of the character described, which is simply and easily mountable and detachable on a standard belt-type printing machine without removal of the standard drive apparatus normally used with continuous forms, whereby the machine can be easily converted from continuous form to cut-form operation by the addition of a simple attachment.

While there has been described what is at present considered to be the preferred embodiment of the invention, it will be understood that various modifications may be made therein, and it is intended to cover in the appended claims all such modifications as fall within the true spirit and scope of the invention.

What I claim as new and desire to secure by Letters Patent of the United States is:

1. Paper transport apparatus for use with discrete sheets of paper in a continuous belt-type line printing machine including a rotatable cylindrical platen, an inked ribbon disposed adjacent to the platen at a printing region, entry drive means for moving the sheets of paper into a printing path extending tangent to the platen through the printing region and past the inked ribbon spaced therefrom, and an exit drive roller spaced from the platen and having a drive surface moving at the same surface speed as that of the platen; said paper transport apparatus comprising a guide frame including two mounting arms spaced apart longitudinally of the platen adapted for attachment to the printing machine, a deflecting plate carried by said mounting arms and extending therebetween and spaced from the platen downstream of the printing region for engaging the leading edge of the associated sheet past the printing region, two adjustment rollers respectively freely rotatably carried by said deflecting plate and adapted for rolling engagement with the platen and cooperating therewith accurately to position said deflecting plate with respect to the platen, two pivot arms respectively carried by said mounting arms for pivotal movement with respect thereto, and a pressure roller freely rotatably carried by said adjustment arms therebetween and disposed for cooperation with the drive surfaces of the exit drive rollers frictionally to engage the associated sheet therebetween, said deflecting plate deflecting the associated sheet into an exit path extending along the platen and thence in a straight line to the exit drive rollers tangent to the platen and such that the leading edge of the sheet moves between the exit rollers and said pressure rollers for engagement thereby when the sheet is in said exit path, whereby the leading edge of the associated sheet is held out of contact with the inked ribbon and is moved around the platen without the formation of slack-producing bulges in the sheet downstream of the printing region.

2. Paper transport apparatus for use with discrete sheets of paper in a continuous belt-type line printing machine including a rotatable cylindrical platen, an inked ribbon disposed adjacent to the platen at a printing region, entry drive means for moving the sheets of paper into a printing path extending tangent to the platen through the printing region and past the inked ribbon spaced therefrom, and an exit drive roller spaced from the platen and having a drive surface moving at the same surface speed as that of the platen; said paper transport apparatus comprising a guide frame having deflecting means thereon spaced from the platen downstream of the printing region and disposed for substantially continuously engaging the leading edge of the associated sheet past the printing region; a pressure roller rotatably carried by said guide frame and disposed for cooperation with the drive surface of the exit drive roller frictionally to engage the associated sheet therebetween, said deflecting means substantially continuously deflecting the associated sheet for a substantial distance past said printing region into an exit path extending along a substantial portion of the peripheral surface of said platen and thence in a straight line to the exit drive roller tangent to the platen such that the leading edge of the sheet moves between the exit roller and said pressure roller for engagement thereby when the sheet is in said exit path, whereby the leading edge of the associated sheet is moved around the platen without the formation of slack-producing bulges in the sheet downstream of the printing region, and an adjustment roller freely rotatably carried by said guide frame and adapted for rolling engagement with the platen accurately to position said deflecting means with respect to the platen.

3. Paper transport apparatus for use with discrete sheets of paper in a continuous belt-type line printing machine including a rotatable cylindrical platen, an inked ribbon disposed adjacent to the platen at a printing region, entry drive means for moving the sheets of paper into a printing path extending tangent to the platen through the printing region and past the inked ribbon spaced therefrom, and an exit drive roller spaced from the platen and having a drive surface moving at the same surface speed as that of the platen; said paper transport apparatus comprising a guide frame having deflecting means thereon spaced from the platen downstream of the printing region and disposed for substantially continuously engaging the leading edge of the associated sheet past the printing region; a pressure roller rotatably carried by said guide frame and disposed for cooperation with the drive surface of the exit drive roller frictionally to engage the associated sheet therebetween, said deflecting means substantially continuously deflecting the associated sheet for a substantial distance past said printing region into an exit path extending along a substantial portion of the peripheral surface of said platen and thence in a straight line to the exit drive roller tangent to the platen such that the leading edge of the sheet moves between the exit roller and said pressure roller for engagement thereby when the sheet is in said exit path, whereby the leading edge of the associated sheet is moved around the platen without the formation of slack-producing bulges in the sheet downstream of the printing region, and two, spaced apart, adjustment rollers carried by said deflecting means and adapted for rolling engagement with the platen accurately to spatially position said deflecting means with respect to the platen.

4. Paper transport apparatus for use with discrete sheets of paper in a continuous belt-type line printing machine including a rotatable cylindrical platen, an inked ribbon disposed adjacent to the platen at a printing region, and entry drive means for moving the sheets of paper into a printing path extending tangent to the platen through the printing region and past the inked ribbon spaced therefrom, said paper transport apparatus comprising an exit drive roller spaced from the platen and having a drive surface moving at the same surface speed as that of the platen, a guide frame comprising deflecting means spaced from the platen downstream of the printing region and disposed for engaging the leading edge of the associated sheet past the printing region, a pressure roller rotatably carried by said guide frame and disposed for cooperation with said drive surface of said exit drive roller frictionally to drive the associated sheet therebetween and away from the printing region, said deflecting means being dimensioned to continuously deflect the associated sheet into an exit path extending along a substantial portion of the peripheral surface of said platen past said printing region and thence in a straight line tangent to the platen for causing the leading edge of the sheet to move between said exit roller and said pressure roller for engagement thereby when the sheet is in said exit path, whereby the leading edge of the associated sheet is moved around the platen without the formation of slack-producing bulges in the sheet downstream of the printing region, and an adjustment roller freely rotatably carried by said guide frame and adapted for rolling engagement with the platen accurately to position said deflecting means with respect to the platen.

5. Paper transport apparatus for use with discrete sheets of paper in a continuous belt-type line printing machine including a rotatable cylindrical platen, an inked ribbon disposed adjacent to the platen at a printing region, entry drive means for moving the sheets of paper into a printing path extending tangent to the platen through the printing region and past the inked ribbon spaced therefrom, and an exit drive roller spaced from the platen and having a drive surface moving at the same surface speed as that of the platen; said paper transport apparatus comprising a guide frame including two mounting arms spaced apart longitudinally of the platen adapted for attachment to the printing machine, a deflecting plate carried by said mounting arms and extending therebetween and spaced from the platen downstream of the printing region for engaging the leading edge of the associated sheet past the printing region, two adjustment rollers respectively freely rotatably carried by said deflecting plate and adapted for rolling engagement with the platen and cooperating therewith accurately to position said deflecting plate with respect to the platen, two pivot arms respectively carried by said mounting arms for pivotal movement with respect thereto, and a pressure roller freely rotatably carried by said adjustment arms therebetween and disposed for cooperation with the drive surfaces of the exit drive rollers frictionally to engage the associated sheet therebetween, said deflecting plate deflecting the associated sheet into an exit path extending along the platen and thence in a straight line to the exit drive rollers tangent to the platen and such that the leading edge of the sheet moves between the exit rollers and said pressure rollers for engagement thereby when the sheet is in said exit path, whereby the leading edge of the associated sheet is held out of contact with the inked ribbon and is moved around the platen without the formation of slack-producing bulges in the sheet downstream of the printing region, and carriage means mounted on said guide frame for pivotal movement with respect thereto, said pressure roller being carried by said carriage means.

* * * * *